US005421524A

United States Patent [19]

Haddow

[11] Patent Number: 5,421,524

[45] Date of Patent: Jun. 6, 1995

[54] METHOD OF MILLING

[75] Inventor: Andrew J. Haddow, Cleveland, England

[73] Assignee: Tioxide Group Services Limited, London, England

[21] Appl. No.: 160,170

[22] Filed: Dec. 2, 1993

[30] Foreign Application Priority Data

Dec. 24, 1992 [GB] United Kingdom ..... 9226994

[51] Int. Cl.[6] ..... B02C 19/06

[52] U.S. Cl. ..... 241/5; 241/18; 241/39

[58] Field of Search ..... 241/5, 18, 39, 24

[56] References Cited

U.S. PATENT DOCUMENTS

| | | | |
|---|---|---|---|
| 2,032,827 | 3/1936 | Andrews . | |
| 2,119,887 | 6/1938 | Myers . | |
| 2,763,437 | 9/1956 | Marchant | 241/39 |
| 2,983,453 | 5/1961 | Bourguet et al. | 241/5 |
| 3,688,991 | 9/1972 | Andrews | 241/5 |
| 3,734,413 | 5/1973 | Kaiser | 241/39 |
| 4,524,915 | 6/1985 | Yamagishi | 241/39 |
| 4,586,661 | 5/1986 | Niemi | 241/34 |
| 4,792,098 | 12/1988 | Haddow | 241/5 |
| 4,832,268 | 5/1989 | Haddow et al. | 241/5 |
| 4,880,169 | 11/1989 | Zander et al. | 241/5 |

FOREIGN PATENT DOCUMENTS

| | | |
|---|---|---|
| 0154498 | 2/1985 | European Pat. Off. . |
| 3140294 | 4/1983 | Germany . |
| 592967 | 7/1944 | United Kingdom . |
| 671580 | 3/1950 | United Kingdom . |
| 785679 | 8/1956 | United Kingdom . |
| 667763 | 10/1962 | United Kingdom . |
| 634723 | 1/1964 | United Kingdom . |
| 2091127 | 7/1982 | United Kingdom . |
| 2111855 | 7/1983 | United Kingdom . |
| 2197804 | 6/1988 | United Kingdom . |
| 2209481 | 5/1989 | United Kingdom . |
| WO8703219 | 6/1987 | WIPO . |

*Primary Examiner*—John Husar
*Attorney, Agent, or Firm*—Baker & Botts

[57] ABSTRACT

An improved method of milling a particulate material in a jet mill is described. The material is fed from a holding vessel to be entrained by a gas, the holding vessel having an ullage which is maintained at a pressure of at least 0.05 MPa but less than the pressure at which gas is introduced to the jet mill. The method is particularly usefully employed in an impact jet mill in which the entrained particles impinge upon a surface, are reflected into another jet and passed into a cylindrical separation chamber. The method enables such an impact mill to be operated under more energy-efficient conditions.

20 Claims, 2 Drawing Sheets

METHOD OF MILLING

FIELD OF THE INVENTION

This invention relates to a method of milling particulate material and in particular to an improved method of feeding particulate material to a jet mill.

DESCRIPTION OF THE BACKGROUND

A number of types of jet mill are known in which particulate material is entrained in a jet of gas and reduced in size either by being caused to impinge upon a target or by collision with other particles. In such a jet mill the energy of the gas, typically steam, used in the jet is significant and it is therefore important to use this energy as efficiently as possible.

It is an object of this invention to provide a method of milling particulate material in a more energy efficient manner than has been possible hitherto.

SUMMARY OF THE INVENTION

According to the invention a method of milling a particulate material comprises passing a gas through a jet nozzle of a jet mill while feeding said particulate material from a holding vessel containing the material through an inlet to be entrained by said gas and passing the mixture of gas and entrained particles so formed into the jet mill wherein the amount of particulate material in the holding vessel is insufficient to fill the vessel thus creating an ullage and a gas is maintained in said ullage at a pressure higher than atmospheric pressure, the pressure of said gas in said ullage being at least 0.05 MPa above atmospheric pressure but less than the pressure at which gas is introduced to the jet nozzle.

DESCRIPTION OF THE INVENTION

Figure 1:
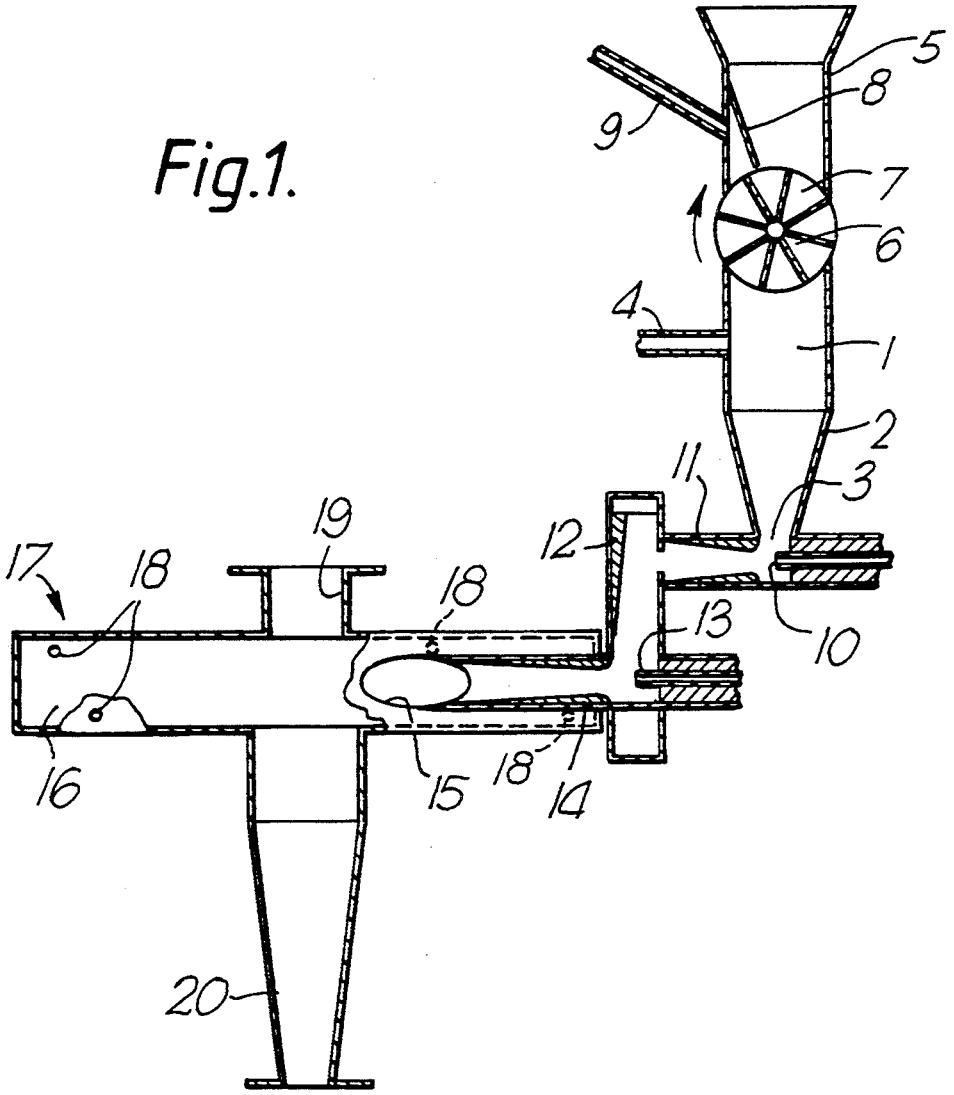
FIG. 1 Diagrammatic view of a jet mill showing part in sectional elevation.

The method of the invention is suitable for use with any jet mill in which milling is achieved by feeding particulate material into a stream of gas passing through a jet. For example, the material can be employed in a confined vortex mill such as is described in U.S. Pat. No. 2,032,827, in a "dog-leg" mill such as is disclosed in British Patent GB 2 111 855 or in a mill employing opposed jets as described in GB 667 763 or GB 2 209 481. It is particularly suitable for use in the jet mill described in British Patent GB 2 197 804 and the method will hereinafter be described more fully with respect to this jet mill.

Hence, according to a preferred embodiment of the invention, a method of milling a particulate material comprises passing a gas through a first jet nozzle while feeding said particulate material from a holding vessel containing the material through an inlet to be entrained by said gas, passing entrained material and gas through a first venturi axially in-line with said first nozzle and spaced therefrom by said inlet to impact on an impact mill surface mounted at a reflective angle to the axis of said first jet and said first venturi and to be reflected therefrom, feeding a gas to a second jet nozzle spaced from said impact mill surface and having a longitudinal axis transverse to the reflected line of the axis of said first jet nozzle and said first venturi to entrain material reflected from said impact mill surface, passing entrained reflected material and gas through a second venturi axially in line with second jet nozzle into a cylindrical separation chamber having a circumferential wall and having outlets for exhaust gas and particulate material and feeding means extending through said circumferential wall comprising said second venturi, separating the milled particulate material from said gas and discharging said separated milled particulate material and said gas separately from said separation chamber wherein the amount of particulate material in the holding vessel is insufficient to fill the vessel thus creating an ullage and a gas is maintained in said ullage at a pressure higher than atmospheric pressure, pressure of said gas in said ullage being at least 0.05 MPa above atmospheric pressure but less than the pressure at which gas is introduced to said first jet nozzle.

The use of pressure to feed the particulate material into the mill used in the preferred method of the invention makes it possible to employ a smaller diameter first venturi than is appropriate when the particulate material is fed at atmospheric pressure. The smaller venturi diameter gives rise to an increased impact velocity at the impact mill surface and hence more efficient milling. It is therefore possible to reduce the amount of gas supplied to the first jet nozzle without reducing the quality of the milled particulate material produced.

The method is of particular use in grinding particulate material to a small controlled size range and particularly for those types of powders, such as pigments, where properties of the product can be changed according to the product size.

Inorganic pigments such as titanium dioxide, silica, silicates, aluminium oxide, antimony pigments, calcium pigments, carbon black, iron oxide, lead oxide, zinc oxide and zirconia are all suitable for grinding in the improved mill. Other materials such as organic coloured pigments and pharmaceutical compositions can be ground in the mill employing a suitable grinding gas.

Typically, the method of the current invention will be employed as the final stage in producing a pigment. For example, a dried, coated titanium dioxide pigment is milled according to the method of the invention immediately before packing. However, it is not essential that the particulate material is dried before being fed to the mill which may be used as a combined mill and dryer.

In the method of the invention, particulate material is stored in a holding vessel from which it is fed into a jet mill. An ullage exists in the holding vessel and is maintained at a pressure at least 0.05 MPa above atmospheric pressure. The actual pressure of the gas in the ullage will depend upon the design of mill which is employed in the method. In the preferred method of the invention the pressure of gas in the ullage is usually maintained between 0.1 and 0.3 MPa above atmospheric pressure.

The gas used to maintain the pressure in the holding vessel can be any gas with which the particulate material is compatible. For example, an inert gas such as nitrogen or carbon dioxide can be used. Preferably, for convenience, the gas is air.

The holding vessel is maintained at a pressure above atmospheric pressure and the method of the invention is preferably operated continuously. It is therefore necessary for the holding vessel to be equipped with a means of continuously adding particulate material to the pressurised vessel. One suitable means comprises an airlock of the type manufactured by Westinghouse known as a Westinghouse Derion airlock. In such an airlock powder drops into a pocket at atmospheric pressure. The pocket is caused to rotate until it passes into a pressurized vessel whereupon the powder drops out under gravity or with the aid of a purge gas flow if required. The pocket continues to rotate until it is vented to atmospheric pressure before again filling with powder.

The method of the invention is suitable for use with mills having any convenient chosen size so as to produce a desired rate of output of milled material and accordingly is suitable for use with laboratory mills and mills up to a full size factory unit.

In the preferred embodiment of the method the first and second jet nozzles and associated venturi throats can have sizes chosen from within a wide size range and the gases fed through the first and second nozzles can be fed under a wide range of pressures chosen to match the particular jet sizes and product characteristics required. In a particularly preferred method the mill has a ratio of throat area of the first venturi to the area of the first jet nozzle of about 3:1 and a ratio of the second venturi throat area to second jet area of about 10:1 for operation at 2 MPa pressure.

Any suitable gas can be used to entrain and transport material to be milled through the mill. Steam or an inert gas can be used as can air. The gas can be heated if desired and in the case of steam the degree of superheat chosen governs the temperature of the gas employed. Generally speaking the gases fed to the first and second jet nozzles will have a pressure of at least 0.5 MPa and preferably have a pressure of at least 1 MPa.

In the preferred embodiment it will be seen that separate supplies of gas are fed to the first and second nozzles and in a particular arrangement the rate of feed is such that the second nozzle is supplied with steam flowing at a rate of up to twice that flowing to the first nozzle. If desired an additional supply of gas is introduced into the separation chamber through one or more inlets in the circumferential wall of the chamber. The total amount of gas fed to the separation chamber through these additional inlets through the circumferential wall can be substantially equal to that supplied to the mill through the first jet nozzle or less.

Generally, the materials of construction of the jet mill appropriate for use in the method of the invention are not critical and suitable materials include stainless steel or a ceramics material. In the preferred method the use of a ceramics material for the impact surface is advantageous since it is less liable to introduce unwanted contamination of the particulate material.

Figure 2:
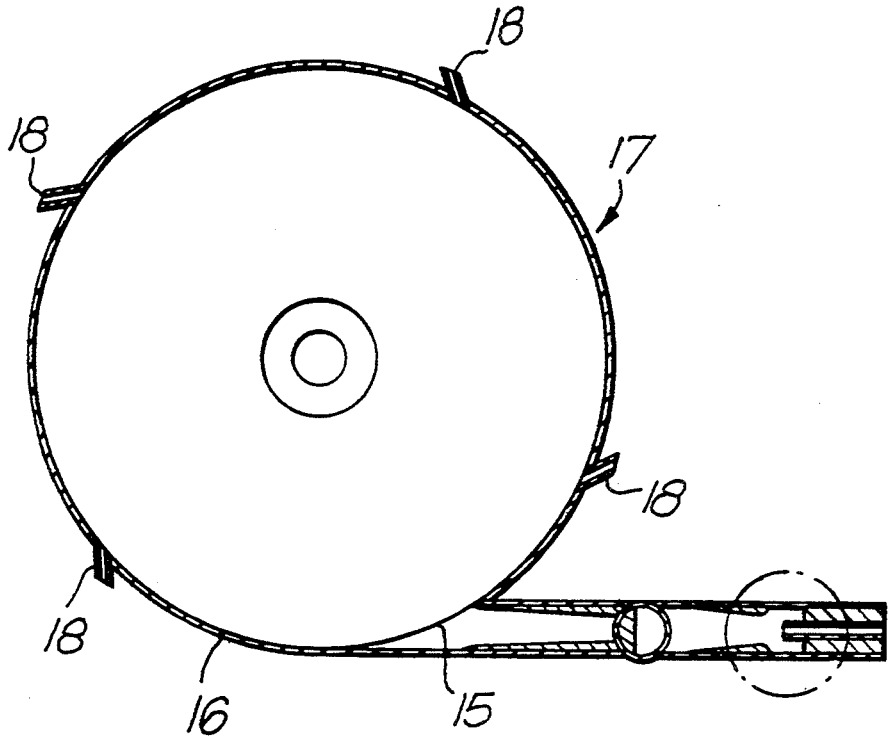
FIG. 2 Sectional plan view of a jet mill.

One form of equipment suitable for use in the preferred method of the invention will now be described by way of example only with reference to the accompanying drawings in which FIG. 1 is a diagrammatic view showing part in sectional elevation and FIG. 2 is a part sectional plan view of the jet mill.

As shown in FIG. 1 a jet mill is equipped with a holding vessel 1 with a generally conical base 2 which communicates with the mill by means of an inlet 3. The holding vessel 1 is fitted with a supply pipe 4 for supplying a compressed gas. A means of supplying particulate material to the holding vessel 1 consists of a hopper 5 mounted above a rotatable air lock 6. The air lock 6 comprises several air lock chambers 7. The hopper 5 is also equipped with a seal 8 and a vent 9.

A first jet nozzle 10 is axially aligned but spaced from a first venturi 11 by the inlet 3. An impact surface 12 is mounted to receive material from the venturi 11 and to reflect the milled particulate material towards a second jet nozzle 13 supplied with a second venturi 14 axially aligned with the jet nozzle 13. The second venturi 14 forms a particulate material feed device to feed particulate material through an inlet 15 in the wall 16 of a cylindrical chamber 17.

The cylindrical wall 16 of the cylindrical chamber 17 is provided with a number of spaced gas inlets 18 directed to feed additional quantities of gas into the cylindrical chamber 17. The cylindrical chamber 17 is provided with a centrally located gas offtake 19 opposite an axially aligned milled particle offtake 20.

In operation the particulate material to be milled is fed through hopper 5 into an air lock chamber 7. The air lock 6 is rotated whereby a portion of particulate material is transported into holding vessel 1 and some gas from holding vessel 1 is vented from an air lock chamber 7 via vent 9 to atmosphere. The holding vessel 1 is maintained at a pressure above atmospheric pressure. If necessary, a gas is supplied through supply pipe 4.

The particulate material is fed through the inlet 3 and becomes entrained in gas supplied through jet nozzle 10. The gas together with the entrained material is fed through venturi 11 and directed on to the impact surface 12 where milling takes place due to impact with the surface prior to being reflected towards the second jet nozzle 13. Gas flowing from the second jet nozzle 13 entrains the material reflected from the impact surface 12 and due to the influence of the second venturi 14 a reduction in pressure occurs together with a positive increase in the rate of flow of the particulate material to be ground on to the impact surface 12. The impacted material after entrainment and passage through the second venturi is fed substantially tangentially into an inlet of the cylindrical chamber 17 through the inlet 15 where additional supplies of gas are introduced through the gas inlets 18 augmenting the flow of gas within the chamber 17 and increasing the milling effect occurring therein due to impact of the particles with each other. As the gaseous fluid and milled particles are transported towards the central regions of the chamber 17 the speed of the flowing gas becomes insufficient to support the milled particles which exit the chamber through the particle offtake 20 and exhaust gas together with any very small particle size material exhausts through the gas offtake 19.

The method of the invention provides a more efficient method of milling with a jet mill. The use of pressure to feed the particulate material to the mill enables the first venturi to be reduced in size compared to that required when feeding at atmospheric pressure is employed. This has been estimated to allow a reduction of about 25% in the amount of steam required to mill a given quantity of titanium dioxide.

The invention is illustrated by the following examples.

EXAMPLE 1

In equipment similar to that illustrated in FIG. 1 coated titanium dioxide pigment discharged from a dryer on a conventional titanium dioxide pigment production plant was fed into a hopper at a rate of 1 te per hour and this was transferred to a holding vessel by means of a rotating air lock. Compressed air was supplied to the holding vessel at a rate of 50 litres per second and a pressure of 0.15 MPa above atmospheric pressure was maintained in the holding vessel.

Steam was supplied to the first and second jets at a gauge pressure of 1 MPa. The first venturi had a throat diameter of 30 mm and the second venturi a throat diameter of 63 mm. The total amount of steam employed was 1.8 te per hour. No steam was supplied to the gas inlets (18) in the cylindrical chamber.

For comparison, similar pigment was fed at atmospheric pressure to the jet mill, which had been modified by fitting a first venturi with a throat diameter of 40 mm. The amount of steam used was 1.8 te per hour.

The surface area of the pigments produced, which is indicative of the efficiency of milling, was estimated by measuring the water demand. The pigment milled according to the method of the invention had a water demand which was approximately 7% higher than the pigment milled using atmospheric pressure on the feeding system.

EXAMPLE 2

As in Example 1 equipment similar to that illustrated in FIG. 1 was used to feed titanium dioxide pigment to a jet mill at a rate of 3.6 te per hour. Compressed air was supplied to the holding vessel at 200 litres per second and the holding vessel was maintained at a pressure of 0.1 MPa above atmospheric pressure.

Steam was supplied to the first jet at a gauge pressure of 1 MPa and to the second jet at a gauge pressure of 0.6 MPa. The first venturi had a throat diameter of 68 mm and the second venturi a throat diameter of 145 mm. The total steam flow as 12 te per hour. No steam was supplied to the gas inlets (18) in the cylindrical chamber.

The product obtained was tested in a printing ink formulation and, for comparison, a standard ink was prepared from a titanium dioxide pigment which had been milled in a similar mill using atmospheric pressure to feed the pigment into the mill, a throat diameter of 92 mm for the first venturi and the same steam flow. The ink containing the pigment of this example had a gloss approximately 15% higher than the standard ink.

EXAMPLE 3

As in Example 1 equipment similar to that illustrated in FIG. 1 was used to feed titanium dioxide pigment to a jet mill at a rate of 5.9 te per hour. Compressed air was fed to the holding vessel at a rate of 160 litres per second and the vessel was maintained at a pressure 0.05 MPa above atmospheric pressure.

Steam was supplied to the first jet at a gauge pressure of 1 MPa and to the second jet at a gauge pressure of 0.3 MPa. The first venturi had a throat diameter of 84 mm and the second venturi a throat diameter of 145 mm. The total steam flow as 10 te per hour. No steam was supplied to the gas inlets (18) in the cylindrical chamber.

As in Example 2 the product was tested in a printing ink against a standard pigment which was milled in a similar mill using an atmospheric pressure feed system, a first venturi with a throat diameter of 92 mm and steam flow of 15 te per hour. The ink containing the pigment of Example 3 had a 5% better gloss level than that containing the standard pigment.

I claim:

1. A method of milling a particulate material comprising establishing a flow of a gas through a jet nozzle of a jet mill and establishing a supply of particulate material in a holding vessel, feeding said particulate material from said holding vessel through an inlet to be entrained by said gas and passing the mixture of gas and entrained particles so formed into the jet mill wherein the amount of particulate material in the holding vessel is insufficient to fill the vessel thus creating an ullage and a gas is maintained in said ullage at a pressure higher than atmospheric pressure, the pressure of said gas in said ullage being at least 0.05 MPa above atmospheric pressure but less than the pressure at which gas is introduced to the jet nozzle.

2. A method according to claim 1 in which the gas used to maintain a pressure in the holding vessel is air, nitrogen or carbon dioxide.

3. A method according to claim 1 in which the particulate material is added to the holding vessel by means of an airlock comprising an arrangement of pockets, said arrangement being capable of rotation so as to transfer material placed in the pockets from a hopper at atmospheric pressure to the holding vessel at a pressure higher than atmospheric pressure.

4. A method according to claim 1 in which the particulate material is selected from the group consisting of inorganic pigments, organic colored pigments and pharmaceutical compositions.

5. A method according to claim 1 in which the particulate material is selected from the group consisting of titanium dioxide, silica, silicates, aluminum oxide, antimony pigments, calcium pigments, carbon black, iron oxide, lead oxide, zinc oxide and zirconia.

6. A method according to claim 1 in which the particulate material fed to the jet mill is wet and the particulate material is simultaneously dried and milled in the jet mill.

7. A method of milling a particulate material comprising establishing a flow of gas through a first jet nozzle and establishing a supply of particulate material in a holding vessel, feeding said particulate material from said holding vessel through an inlet to be entrained by said gas, passing entrained material and gas through a first venturi axially in-line with said first nozzle and spaced therefrom by said inlet to impact on an impact mill surface mounted at a reflective angle to the axis of said first jet and said first venturi and to be reflected therefrom, feeding a gas to a second jet nozzle spaced from said impact mill surface and having a longitudinal axis transverse to the reflected line of the axis of said first jet nozzle and said first venturi, to entrain material reflected from said impact mill surface, passing entrained reflected material and gas through a second venturi axially in line with second jet nozzle into a cylindrical separation chamber having a circumferential wall and having outlets for exhaust gas and particulate material and feeding means extending through said circumferential wall comprising said second venturi, separating the milled particulate material from said gas and discharging said separated milled particulate material and said gas separately from said separation chamber wherein the amount of particulate material in the holding vessel is insufficient to fill the vessel thus creating an ullage and a gas is maintained in said ullage at a pressure higher than atmospheric pressure, the pressure of said gas in said ullage being at least 0.05 MPa above atmospheric pressure but less than the pressure at which gas is introduced to said first jet nozzle.

8. A method according to claim 7 in which the pressure of gas in the ullage is from 0.1 to 0.3 MPa above atmospheric pressure.

9. A method according to claim 7 in which gas is fed to each of said first jet nozzle and said second jet nozzle at a pressure of at least 0.5 MPa.

10. A method according to claim 7 in which gas is fed to each of said first jet nozzle and said second jet nozzle at a pressure of at least 1.0 MPa.

11. A method according to claim 7 in which the ratio of throat area of the first venturi to the area of the first jet nozzle is about 3:1 and the ratio of the second venturi throat area to the area of the second jet nozzle is about 10:1 and gas is supplied to each of the jet nozzles at a pressure of about 2 MPa.

12. A method according to claim 7 in which the gas supplied to the first jet nozzle and to the second jet nozzle is steam or air.

13. A method according to claim 7 in which steam is supplied to the second jet nozzle at a rate up to twice the rate flowing through the first jet nozzle.

14. A method according to claim 7 in which gas is introduced into the cylindrical separation chamber through one or more additional inlets in the circumferential wall of the chamber.

15. A method according to claim 7 in which the impact mill surface is formed from a ceramics material.

16. A method according to claim 7, in which the gas used to maintain a pressure in the holding vessel is air, nitrogen or carbon dioxide.

17. A method according to claim 7, in which the particulate material is added to the holding vessel by means of an airlock comprising an arrangement of pockets, said arrangement being capable of rotation so as to transfer material placed in the pockets from a hopper at atmospheric pressure to the holding vessel at a pressure higher than atmospheric pressure.

18. A method according to claim 7 in which the particulate material is selected from the group consisting of inorganic pigments, organic colored pigments and pharmaceutical compositions.

19. A method according to claim 7 in which the particulate material is selected from the group consisting of titanium dioxide, silica, silicates, aluminum oxide, antimony pigments, calcium pigments, carbon black, iron oxide, lead oxide, zinc oxide and zirconia.

20. A method according to claim 7 in which the particulate material fed to the jet mill is wet and the particulate material is simultaneously dried and milled in the jet mill.

* * * * *